US010451999B2

(12) United States Patent
Sato

(10) Patent No.: US 10,451,999 B2
(45) Date of Patent: Oct. 22, 2019

(54) PROCESS CARTRIDGE AND IMAGE FORMING APPARATUS INCLUDING THE SAME

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/134,329

(22) Filed: Sep. 18, 2018

(65) Prior Publication Data

US 2019/0018344 A1 Jan. 17, 2019

Related U.S. Application Data

(63) Continuation of application No. 15/468,788, filed on Mar. 24, 2017, now Pat. No. 10,082,747, which is a (Continued)

(30) Foreign Application Priority Data

Jan. 27, 2010 (JP) ..... 2010-015307

(51) Int. Cl.
*G03G 15/08* (2006.01)
*G03G 21/18* (2006.01)

(52) U.S. Cl.
CPC ..... *G03G 15/0865* (2013.01); *G03G 15/0877* (2013.01); *G03G 15/0889* (2013.01);

(Continued)

(58) Field of Classification Search
CPC ..... G03G 15/0886; G03G 15/0877; G03G 15/0875; G03G 15/0865

(Continued)

(56) References Cited

U.S. PATENT DOCUMENTS 5,235,389 A 8/1993 Kikuchi et al.
5,325,163 A 6/1994 Nishio (Continued)

FOREIGN PATENT DOCUMENTS

JP H0635321 A 2/1994
JP H06-148968 A 5/1994

(Continued)

OTHER PUBLICATIONS

Dec. 12, 2011—(CN) First Office Action—App 201010174397.8.

(Continued)

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

A process cartridge includes a first cartridge and a second cartridge. The first cartridge includes a first wall having a first opening, a first shutter configured to open and close the first opening, and a first operating portion configured to operate together with the first shutter. The second cartridge is mountable onto and demountable from the first cartridge and contains a developer. The second cartridge includes a second wall facing the first wall and having a second opening corresponding to the first opening, a second shutter configured to open and close the second opening, and a second operating portion configured to operate together with the second shutter. The first cartridge further includes a third operating portion. When the second cartridge is mounted onto the first cartridge, the first operating portion and the third operating portion operate together through the second operating portion.

10 Claims, 10 Drawing Sheets

Related U.S. Application Data continuation of application No. 15/158,449, filed on May 18, 2016, now Pat. No. 9,612,571, which is a continuation of application No. 14/860,236, filed on Sep. 21, 2015, now Pat. No. 9,348,306, which is a continuation of application No. 14/512,935, filed on Oct. 13, 2014, now Pat. No. 9,146,532, which is a continuation of application No. 14/022,144, filed on Sep. 9, 2013, now Pat. No. 8,862,035, which is a continuation of application No. 13/015,380, filed on Jan. 27, 2011, now Pat. No. 8,532,543, which is a continuation-in-part of application No. 12/975,472, filed on Dec. 22, 2010, now Pat. No. 8,526,862.

(52) U.S. Cl.
CPC ..... *G03G 21/1814* (2013.01); *G03G 21/1821* (2013.01); *G03G 21/1832* (2013.01); *G03G 21/1842* (2013.01); *G03G 2221/1869* (2013.01)

(58) Field of Classification Search
USPC ..... 399/262
See application file for complete search history.

(56) References Cited

U.S. PATENT DOCUMENTS

| | | | |
|---|---|---|---|
| 6,185,401 | B1 | 2/2001 | Kanamori et al. |
| 7,734,231 | B2 | 6/2010 | Eto et al. |
| 7,826,779 | B2 | 11/2010 | Mase et al. |
| 7,953,351 | B2 | 5/2011 | Isomura et al. |
| 7,983,590 | B2 | 7/2011 | Sakuma |
| 8,526,862 | B2 | 9/2013 | Sato |
| 8,532,543 | B2 | 9/2013 | Sato |
| 8,600,267 | B2 | 12/2013 | Sato |
| 8,862,034 | B2 | 10/2014 | Sato |
| 8,862,035 | B2 | 10/2014 | Sato |
| 9,146,532 | B2 | 9/2015 | Sato |
| 9,348,306 | B2 | 5/2016 | Sato |
| 9,366,993 | B2 | 6/2016 | Sato |
| 9,612,571 | B2 | 4/2017 | Sato |
| 9,753,400 | B2 | 9/2017 | Sato |
| 2006/0193652 | A1 | 8/2006 | Sato |
| 2007/0065184 | A1 | 3/2007 | Sato |
| 2007/0122175 | A1 | 5/2007 | Sato |
| 2007/0189811 | A1 | 8/2007 | Sato |
| 2008/0025758 | A1 | 1/2008 | Sato |
| 2008/0075506 | A1 | 3/2008 | Sato |
| 2008/0175627 | A1 | 7/2008 | Sato |
| 2008/0279595 | A1 | 11/2008 | Uezono |
| 2008/0292331 | A1* | 11/2008 | Yokomori ..... G03G 15/0856 399/27 |
| 2008/0298837 | A1 | 12/2008 | Mase |
| 2009/0087215 | A1 | 4/2009 | Sakuma |
| 2009/0087227 | A1 | 4/2009 | Takagi et al. |
| 2009/0274491 | A1 | 11/2009 | Sato |
| 2011/0158698 | A1 | 6/2011 | Sato |
| 2016/0266540 | A1 | 9/2016 | Sato |
| 2016/0274496 | A1 | 9/2016 | Sato |

FOREIGN PATENT DOCUMENTS

| | | | |
|---|---|---|---|
| JP | H08240976 | A | 9/1996 |
| JP | H10-239969 | A | 9/1998 |
| JP | 2005-326869 | A | 11/2005 |
| JP | 2007-086324 | A | 4/2007 |
| JP | 2007086622 | A | 4/2007 |
| JP | 2007-212966 | A | 8/2007 |
| JP | 2008191578 | A | 8/2008 |
| JP | 2008203830 | A | 9/2008 |
| JP | 2008216454 | A | 9/2008 |
| JP | 2008233862 | A | 10/2008 |
| JP | 2009-086505 | A | 4/2009 |
| JP | 2009-265537 | A | 11/2009 |
| JP | 2009-271099 | A | 11/2009 |

OTHER PUBLICATIONS

Jan. 25, 2011—(JP) Office Action—App 2009-109614—English Tran.
Sep. 20, 2011—(JP) Decision to Grant a Patent—App 2009-294200.
Aug. 30, 2012—(CN) Decision of Rejection—App 201010174397.8.
Jan. 31, 2012—(JP) Decision to Grant a Patent—App 2010-015307.
Apr. 2, 2013—(US) Final Office Action—U.S. Appl. No. 12/767,314.
Jul. 22, 2013—(US) Notice of Allowance—U.S. Appl. No. 12/767,314.
Dec. 24, 2014—(US) Non-final Office Action—U.S. Appl. No. 14/093,816.
Jul. 27, 2015—(US) Final Office Action—U.S. Appl. No. 14/093,816.
Mar. 1, 2016—(US) Notice of Allowance—U.S. Appl. No. 14/093,816.
Oct. 7, 2016—(US) Non-Final Office Action—U.S. Appl. No. 15/171,715.
Nov. 28, 2016—(US) Notice of Allowance—U.S. Appl. No. 15/158,449.
May 5, 2017—(US) Notice of Allowance—U.S. Appl. No. 15/171,715.
Dec. 6, 2017—(US)—Non-final Office Action—U.S. Appl. No. 15/468,788.
Jan. 23, 2018—(US) Notice of Allowance—U.S. Appl. No. 15/687,917.
May 21, 2018—(US) Notice of Allowance—U.S. Appl. No. 15/468,788.

* cited by examiner

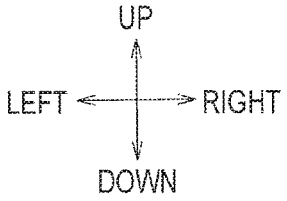
Fig.6A
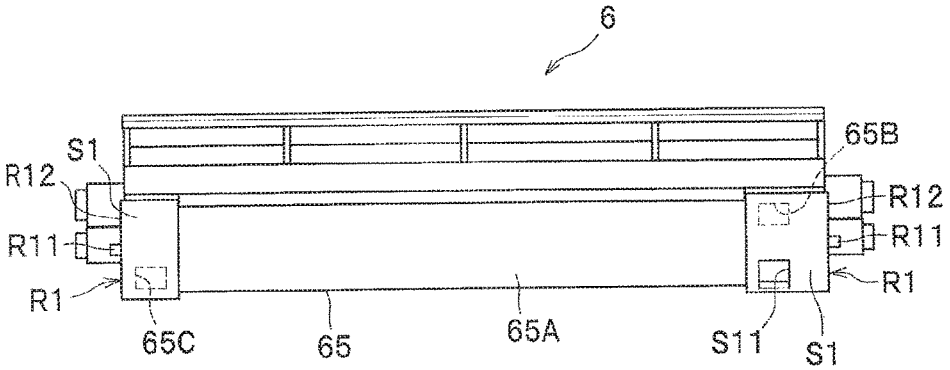
Fig.6B
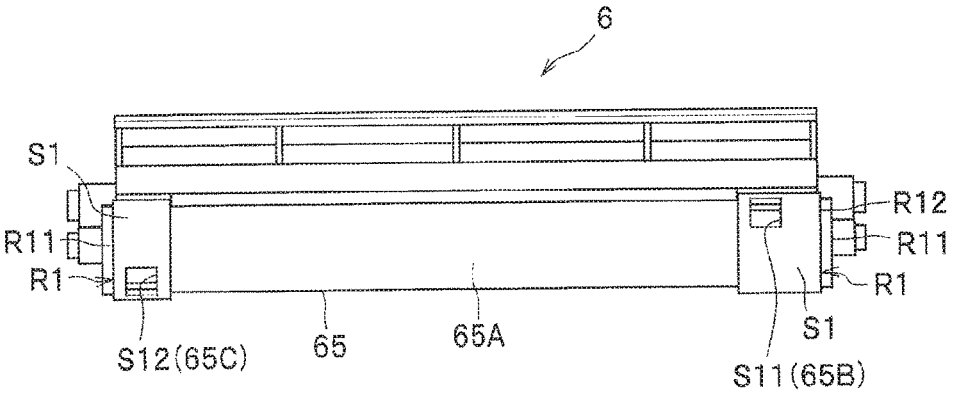

PROCESS CARTRIDGE AND IMAGE FORMING APPARATUS INCLUDING THE SAME

CROSS REFERENCE TO RELATED APPLICATION

The present application is a continuation of U.S. application Ser. No. 15/468,788, filed Mar. 24, 2017, which is a continuation of U.S. application Ser. No. 15/158,449, filed May 18, 2016, which is a continuation of U.S. application Ser. No. 14/860,236, filed Sep. 21, 2015, which is a continuation of U.S. application Ser. No. 14/512,935, filed Oct. 13, 2014, now U.S. Pat. No. 9,146,532, which is a continuation of U.S. application Ser. No. 14/022,144, filed Sep. 9, 2013, now U.S. Pat. No. 8,862,035, which is a continuation of U.S. application Ser. No. 13/015,380, filed Jan. 27, 2011, now U.S. Pat. No. 8,532,543, which is a Continuation-in-Part of U.S. application Ser. No. 12/975,472, filed Dec. 22, 2010, now U.S. Pat. No. 8,526,862, all of which claim priority from Japanese Patent Application No. 2010-015307, which was filed on Jan. 27, 2010, the disclosures of which are incorporated herein by reference in its entirety.

BACKGROUND

1. Field of the Invention

The present invention relates to a process cartridge mountable into and demountable from an apparatus body of an image forming apparatus.

2. Description of the Related Art

A process cartridge having a mechanism in which a shutter is moved by a force from an apparatus body is known.

In the process cartridge, since a plurality of gears for moving the shutter are used, the configuration is complicated.

SUMMARY

A need has arisen to provide a process cartridge which can open and close the shutter with a simple configuration and an image forming apparatus including the process cartridge.

According to an embodiment of the present invention, the process cartridge includes a first cartridge and a second cartridge. The first cartridge is mountable into and demountable from an apparatus body. The first cartridge includes a first wall having a first opening, a first shutter configured to open and close the first opening, and a first operating portion configured to operate together with the first shutter. The second cartridge is mountable onto and demountable from the first cartridge and contains a developer. The second cartridge includes a second wall facing the first wall and having a second opening corresponding to the first opening, a second shutter configured to open and close the second opening, and a second operating portion configured to operate together with the second shutter. The first cartridge further includes a third operating portion. When the second cartridge is mounted onto the first cartridge, the first operating portion and the third operating portion operate together through the second operating portion.

According to another embodiment of the present invention, the image forming apparatus includes an apparatus body including an engaging portion and a process cartridge mountable into and demountable from an apparatus body. The process cartridge includes a developer-containing device, a developing device, a shutter and an operating portion. The developer-containing device is configured to contain a developer and includes an agitator configured to rotate to agitate the developer. The developing device is positioned adjacent to the developer-containing device. The shutter is configured to partition between the developer-containing device and the developing device. The shutter allows the developer to be supplied from the developer-containing device to the developing device when the shutter is opened. The shutter prevents the developer from being supplied from the developer-containing device to the developing device when the shutter is closed. The operating portion is configured to operate together with the shutter. The engaging portion and the operating portion forms a guiding groove or a projection extending in a mounting direction in which the process cartridge is mounted into the apparatus body when the shutter is closed. When the process cartridge is mounted onto the apparatus body, the operating portion engages with the engaging portion to operate together, and opens and closes the shutter without rotating the agitators.

BRIEF DESCRIPTION OF THE DRAWINGS

FIGS. 6A and 6B are front views of a developing device when a first shutter is at a closing position and at an opening position, respectively.

DESCRIPTION OF THE PREFERRED EMBODIMENTS

An embodiment of the present invention will now be described in detail referring to the accompanying drawings. In the following description, the overall configuration of a laser printer is first briefly described, and detailed features of the present invention are subsequently described.

In the following description, directions are denoted with respect to the user who are using the laser printer. Specifically, in FIG. 1, the right side is denoted by "the front side (the near side)", the left side is denoted by "the rear side (the far side)", the far side is denoted by "the right side", the near side is denoted by "the left side", and the vertical direction is denoted by "the vertical direction". In cross-sectional views, only some particular parts are hatched for easier recognition.

[Overall Configuration of Laser Printer]

Figure 1:
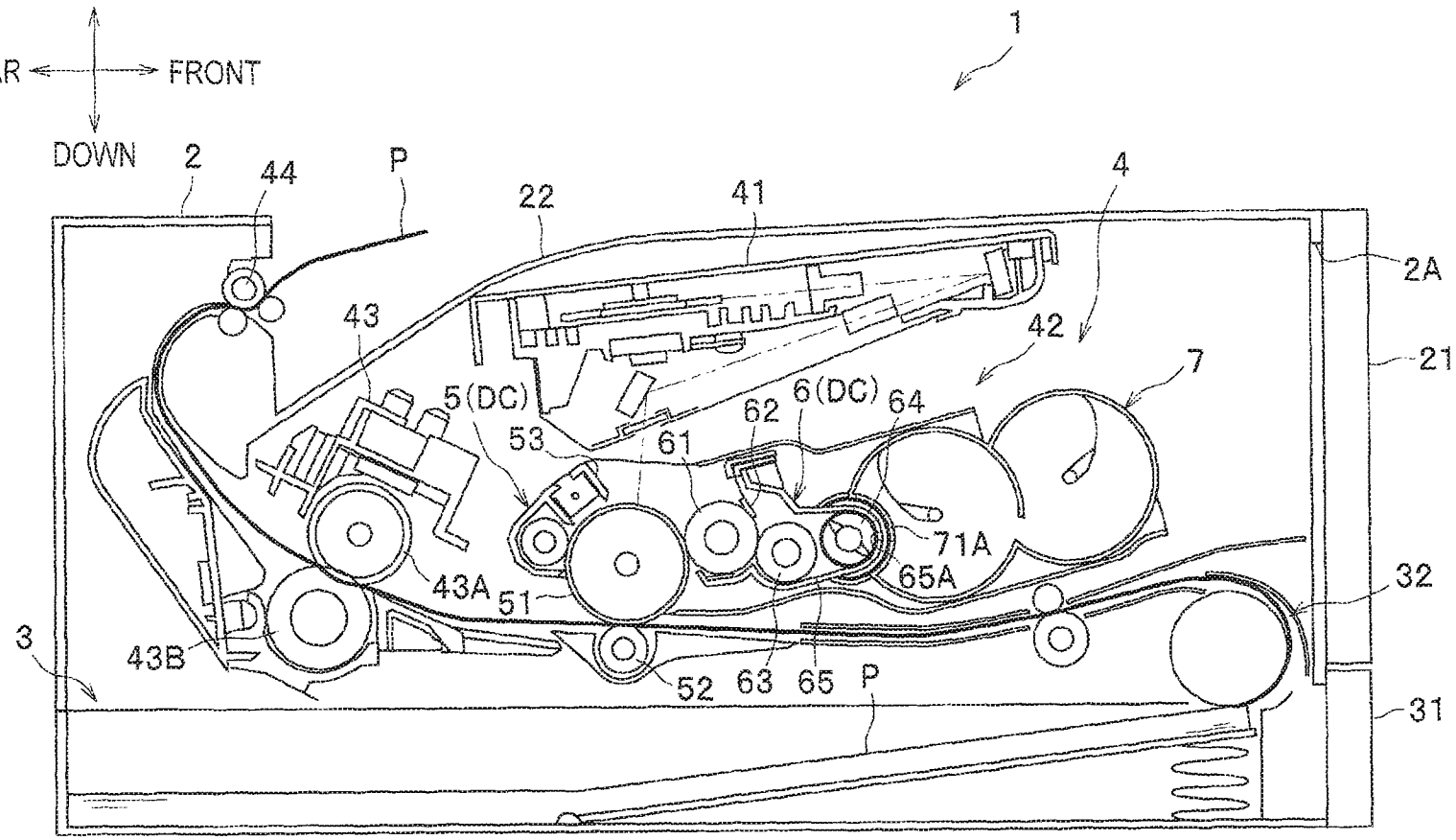
FIG. 1 is a cross-sectional view of a laser printer including a process cartridge according to an embodiment of the present invention.

Referring to FIG. 1, a laser printer 1 includes an apparatus body 2, a feed section 3, an image-forming section 4, and so forth.

The apparatus body 2 is a hollow casing having an opening 2A in the front wall thereof. A front cover 21 is provided on the front wall of the apparatus body 2 in such a manner as to swing back and forth, thereby opening/closing the opening 2A. The top face of the apparatus body 2 forms a discharge tray 22 onto which printed paper P is to be placed.

The feed section 3 includes a paper tray 31, a paper-feeding mechanism 32, and so forth. In the feed section 3, the paper-feeding mechanism 32 separates each of pieces of paper P placed in the paper tray 31 from the others and conveys the separated piece of paper P to the image-forming section 4.

The image-forming section 4 includes a scanner unit 41, a process cartridge 42, a fixing device 43, and so forth.

The scanner unit 41 has a known configuration basically including a laser emitter (not shown), a polygonal mirror, a lens, a reflector (reference numerals are omitted), and so forth. In the scanner unit 41, a laser beam travels along a path shown by the two-dot chain line in FIG. 1, and is applied to the surface of a photosensitive drum 51, included in the process cartridge 42, by rapid scanning.

Figure 2:
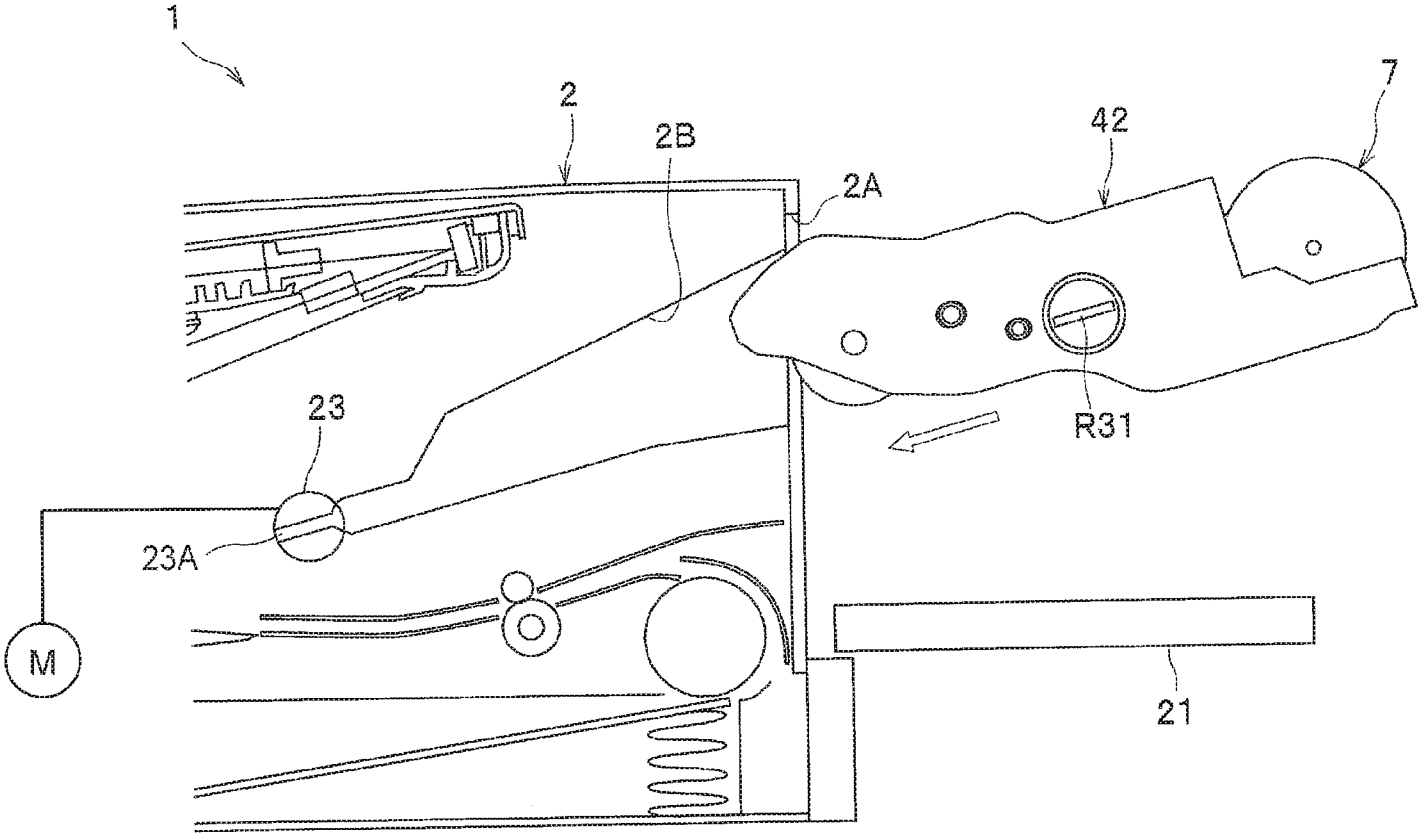
FIG. 2 is a cross-sectional view showing a state where a front cover is opened and the process cartridge is being mounted.

The process cartridge 42 is mountable into and demountable from the apparatus body 2 by opening the front cover 21 according to need (see FIG. 2). The process cartridge 42 includes a developing cartridge DC (an example of a first cartridge) and a developer cartridge 7 (an example of a second cartridge) mountable onto and demountable from the developing cartridge DC.

The developing cartridge DC is mountable into and demountable from the apparatus body 2, and basically includes a drum unit 5 and a developing device 6 supported by the drum unit 5.

The drum unit 5 includes the photosensitive drum 51 (an example of a photosensitive member), a scorotron charger 53 and so forth. A transfer roller 52 provided on the apparatus body 2 faces the photosensitive drum 51.

The developing device 6 basically includes a developing roller 61 (an example of a developer-bearing member), a thickness-regulating blade 62, and a supplying roller 63.

The developer cartridge 7 (e.g. a toner cartridge) contains toner (an example of a developer) and is capable of conveying the toner into the developing device 6 provided adjacent thereto. The developing cartridge DC and the developer cartridge 7 will be described in detail separately below.

In the process cartridge 42 configured as above, the toner conveyed from the developer cartridge 7 into the developing device 6 is supplied onto the developing roller 61 by the supplying roller 63 that is rotating, and is positively charged by friction between the supplying roller 63 and the developing roller 61. The toner supplied onto the developing roller 61 is evened out by the thickness-regulating blade 62 that is in sliding contact with the developing roller 61 that is rotating and scrapping the developer on the developing roller 61, whereby a thin layer of toner having a uniform thickness is borne by the developing roller 61.

Meanwhile, in the drum unit 5, the surface of the photosensitive drum 51 is uniformly and positively charged by the scorotron charger 53, and is subsequently exposed with the laser beam from the scanner unit 41 by rapid scanning. Thus, the potentials of the exposed portions of the photosensitive drum 51 are reduced, whereby an electrostatic latent image based on image data is formed. Subsequently, with the rotation of the developing roller 61, the toner on the developing roller 61 is supplied onto the electrostatic latent image on the photosensitive drum 51 by coming into contact with the photosensitive drum 51.

Thus, the toner is selectively borne by the photosensitive drum 51, and the electrostatic latent image is visualized by reversal development, whereby a toner image is obtained. Subsequently, when a piece of paper P is conveyed through the nip between the photosensitive drum 51 and the transfer roller 52, the toner image on the photosensitive drum 51 is transferred onto the piece of paper P.

The fixing device 43 includes a heating roller 43A and a pressing roller 43B. In the fixing device 43, the toner transferred onto the piece of paper P is thermally fixed while the piece of paper P is conveyed through the nip between the heating roller 43A and the pressing roller 43B. The piece of paper P subjected to the thermal fixing performed by the fixing device 43 is discharged onto the discharge tray 22 by a discharging roller 44 provided on the downstream side with respect to the fixing device 43.

[Details of Developing Cartridge and Developer Cartridge]

The configurations of the developing cartridge DC and the developer cartridge 7 will now be described in detail.

As shown in FIG. 1, the developing device 6 of the developing cartridge DC, including the developing roller 61, the thickness-regulating blade 62, and the supplying roller 63 as described above, further includes an auger 64 and a developing-device case 65 in which the foregoing components are provided. The developing device 6 is supported movably with respect to the drum unit 5, thereby the developing cartridge DC is formed.

Figure 3:
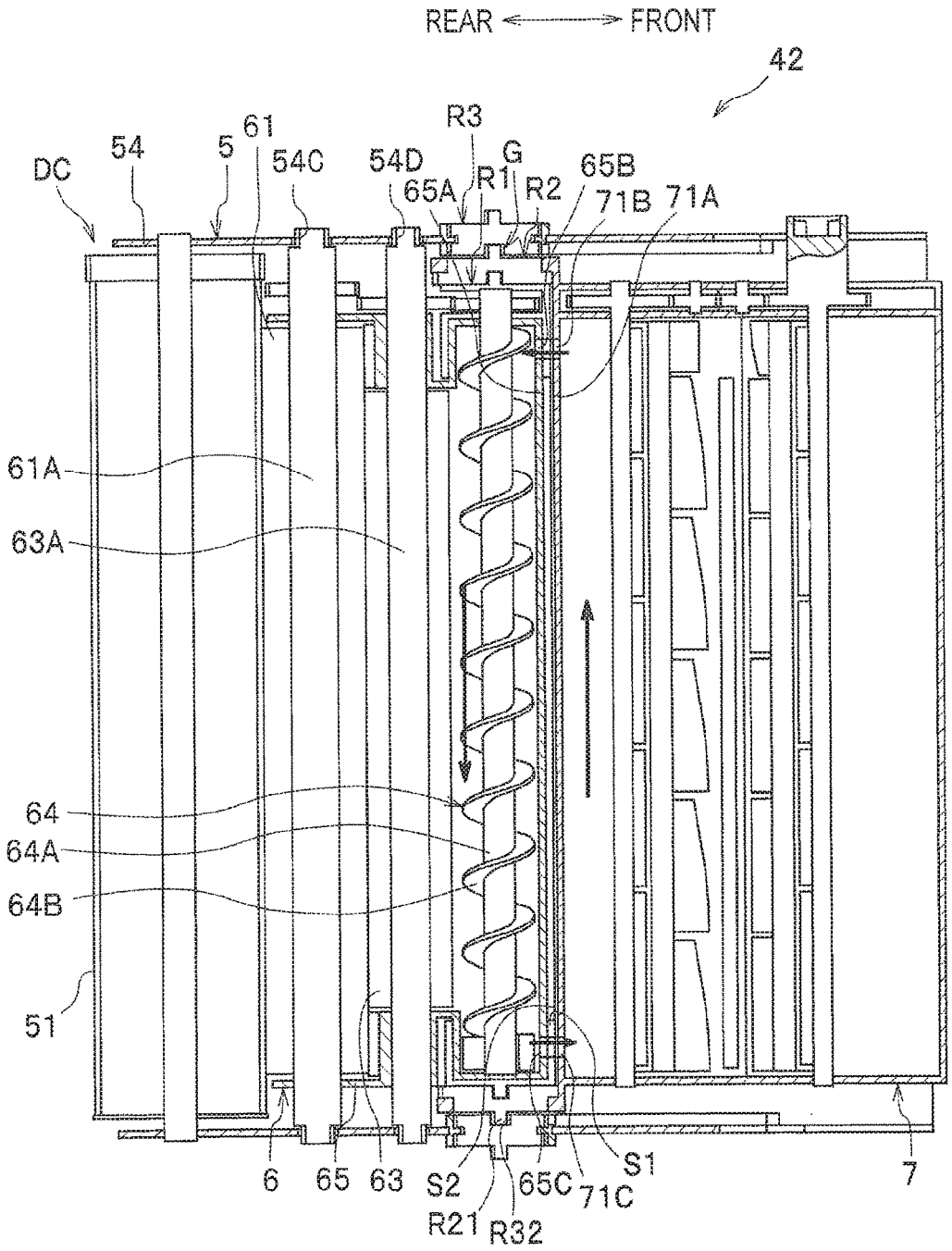
FIG. 3 is a cross-sectional view of the process cartridge taken along the axial direction of an auger.

The auger 64 conveys toner in the axial direction of the supplying roller 63. Referring to FIG. 3, the auger 64 includes a rotating shaft 64A and a spiral blade 64B provided in spirals around the rotating shaft 64A. The auger 64 is provided on the front side (on a lateral side) with respect to the supplying roller 63. The rotating shaft 64A is rotatably supported by the developing-device case 65.

The developing device 6 and the developer cartridge 7 have partition walls 65A and 71A, respectively, provided therebetween in such a manner as to separate the insides thereof. The partition walls 65A and 71A faces each other and are adjoined to each other. Referring to FIG. 1, the partition walls 65A and 71A are provided on a side across the auger 64 from the supplying roller 63 and around the auger 64 in such a manner as to extend above and below the auger 64. Thus, the auger 64 conveys toner in a good manner. The partition wall 65A of the developing device 6 is an example of a first adjoining wall, and the partition wall 71A of the developer cartridge 7 is an example of a second adjoining wall.

The partition walls 65A and 71A each have an arc shape in cross-sectional view that is concave from the side near the developing device 6 toward the developer cartridge 7, and a semicylindrical shape surrounding the auger 64 when seen in the axial direction of the auger 64. The "semicylindrical shape" refers to a shape of a cylinder having a portion thereof cut off, rather than a shape of an exactly half cylinder. With the partition walls 65A and 71A each having such a semicylindrical shape, the auger 64 conveys toner in a better manner.

The semicylindrical partition walls 65A and 71A are positioned such that the centers of curvature thereof overlap the auger 64 when seen in the axial direction of the auger 64, specifically, the centers of curvature thereof coincide with the center of rotation of the auger 64. Thus, the auger 64 conveys toner in a better manner.

Referring to FIG. 3, the two adjoining partition walls 65A and 71A have supply ports 65B and 71B, respectively, through which toner is supplied from the developer cartridge 7 to the developing device 6 and return ports 65C and 71C, respectively, through which toner is returned from the developing device 6 to the developer cartridge 7. The supply port 65B of the developing device 6 is an example of a first opening, and the supply port 71B of the developer cartridge 7 is an example of a second opening.

The supply ports 65B and 71B are provided at positions deviated from the return ports 65C and 71C, respectively, in the axial and rotating directions of the auger 64 (see FIGS. 5A to 6B).

Referring to FIGS. 4 to 6B, the developer cartridge 7 and the developing device 6 are provided with a first shutter S1 and a second shutter S2, respectively. The first and second shutters S1 and S2 are movable along the peripheries of the partition walls 71A and 65A, thereby opening/closing the supply ports 71B and 65B and the return ports 71C and 65C.

Referring to FIG. 6A, the first shutter S1 provided on the developing device 6 includes two first shutters S1 having arc shapes in cross-sectional view. The first shutters S1 are provided at right and left ends, respectively, of the partition wall 65A. The first shutters S1 have openings S11 and S12 (see FIG. 6B), respectively. The opening S11 corresponds to the supply port 65B. The opening S12 corresponds to the return port 65C. Therefore, when the openings S11 and S12 are deviated from the supply port 65B and the return port 65C as shown in FIG. 6A, the supply port 65B and the return port 65C are closed. When the openings S11 and S12 coincide with the supply port 65B and the return port 65C as shown in FIG. 6B, the supply port 65B and the return port 65C are opened.

Figure 4:
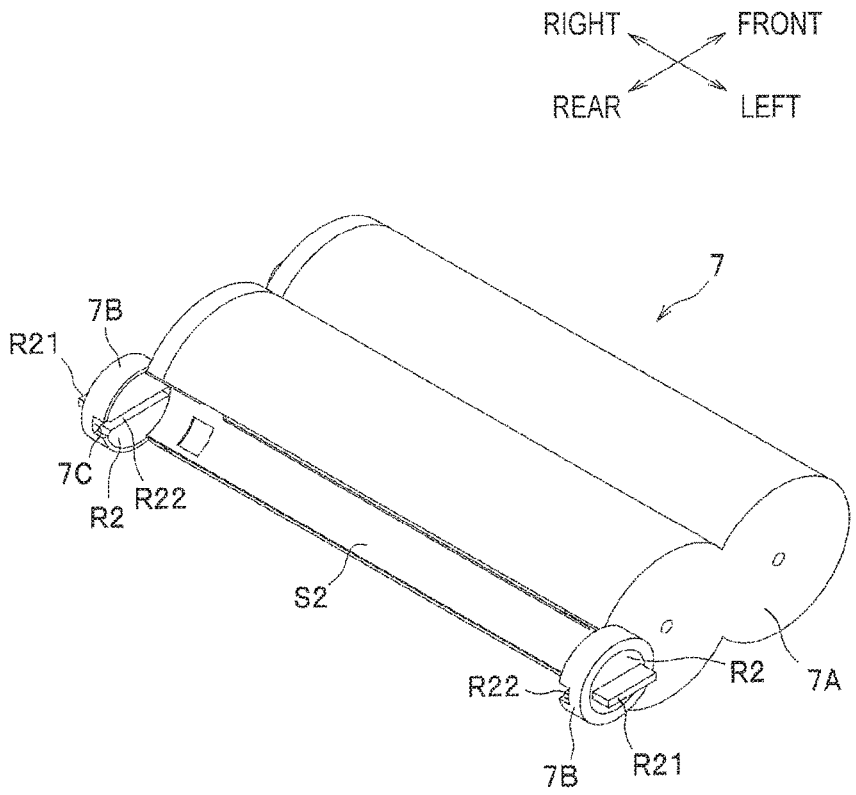
FIG. 4 is a perspective view of a developer cartridge.

The first shutters S1 have on the axially outer ends thereof first rotatable members R1, respectively, having disc-like shapes (substantially the same shapes as second rotatable members R2 shown in FIG. 4). The first rotatable members R1 are exemplary first operating portions and are integrally secured to the respective first shutters S1 in such a manner as to be rotatable (operable) together with the first shutters S1. The second rotatable members R2 are exemplary second operating portions. That is, each of the first shutters S1 and a corresponding one of the first rotatable members R1 in combination form a substantially cylindrical member having a bottom, and the cylindrical member is rotatably held by the developing-device case 65. The first rotatable members R1 have first outer engaging portions R11, respectively, on outer faces R12 thereof (on the faces thereof near the second operating portions).

Figure 9:
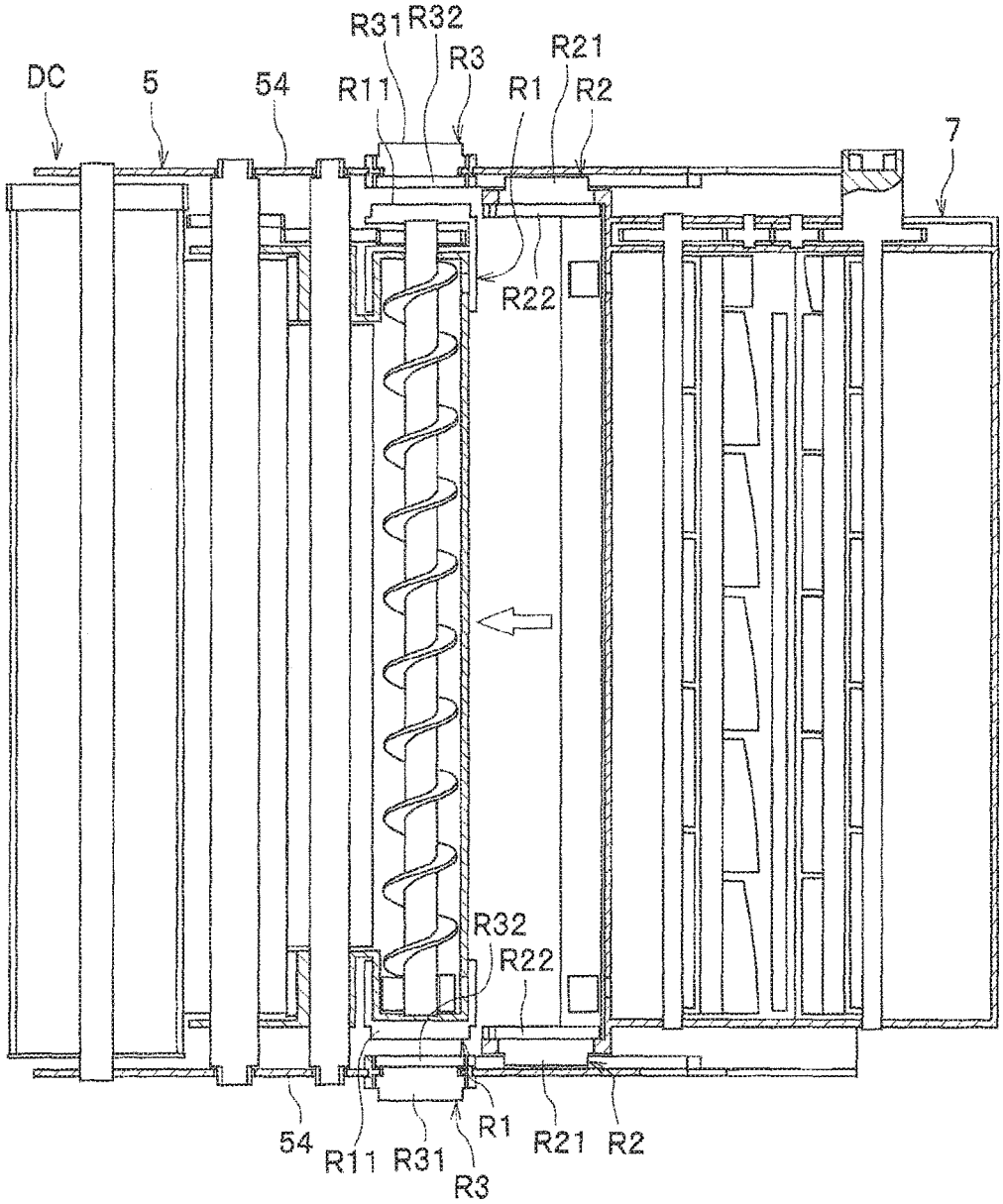
FIG. 9 is a cross-sectional view showing a state where the developer cartridge is being mounted onto the developing cartridge.

The first outer engaging portions R11 are projections projecting laterally outward and forming long ribs. In a state where the first shutters S1 are at closing positions (see FIG. 6A), the first outer engaging portions R11 extend in the direction in which the developer cartridge 7 is mounted onto the developing cartridge DC (see FIG. 9). As shown in FIG. 9, the first outer engaging portions R11 are positioned on the inner sides with respect to and are spaced apart from third rotatable members R3, respectively, provided on right and left frames 54 of the drum unit 5. The third rotatable members R3 are exemplary third operating portions.

Figure 8A:
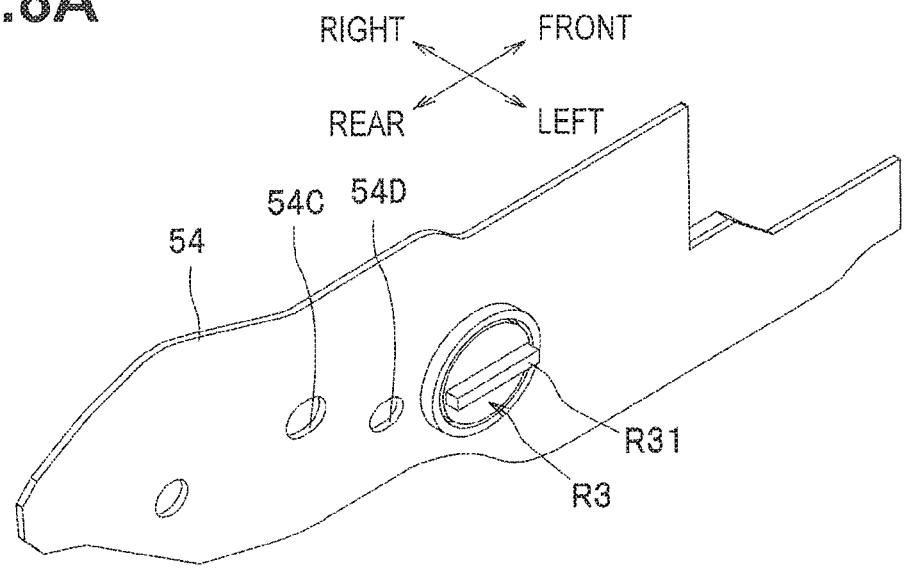
FIGS. 8A and 8B are perspective views of a frame of a drum unit as seen from the outside and from the inside, respectively.
Figure 8B:
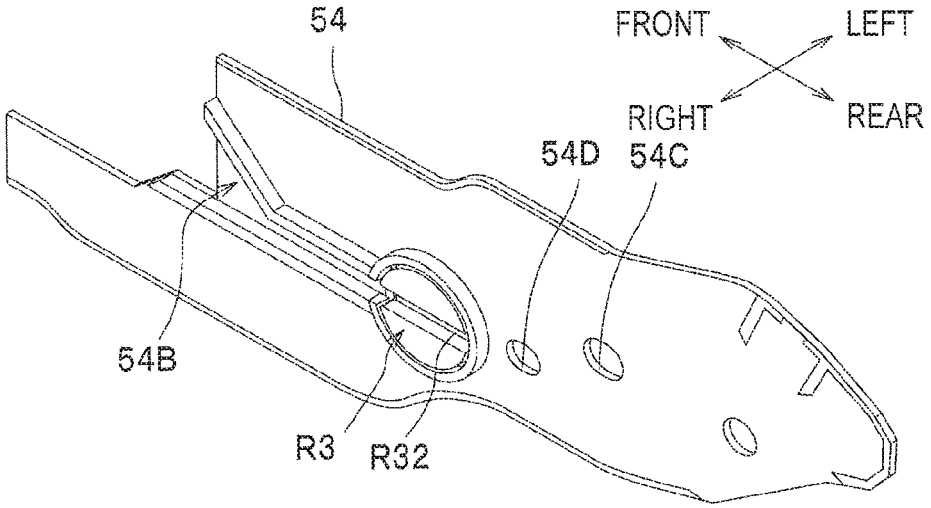

The third rotatable members R3 are rotatably held by the right and left frames 54 of the drum unit 5 such that the axes of rotation thereof coincide with the axes of rotation of the first rotatable members R1. In other words, the third rotatable members R3 are rotatable in the direction in which the first rotatable members R1 rotate (operate). Referring to FIG. 8A, the third rotatable members R3 have third outer engaging portions R31, respectively, on the outer faces thereof (on the faces thereof near the apparatus body 2). Referring to FIG. 8B, the third rotatable members R3 also have third inner engaging portions R32, respectively, on the inner faces thereof (on the faces thereof near the second operating portions).

The third outer engaging portions R31 are projections projecting laterally outward and forming long ribs. In the state where the first shutters S1 are at the closing positions because, for example, the process cartridge 42 (the developing cartridge DC) is demounted from the apparatus body 2 as shown in FIG. 2, the third outer engaging portions R31 extend in the direction in which the process cartridge 42 is mounted into the apparatus body 2.

Therefore, when the process cartridge 42 (the developing cartridge DC) is mounted into the apparatus body 2, the third outer engaging portions R31 engage with couplings 23 (members transmitting a driving force), respectively, provided on the apparatus body 2. Such engagement allows the driving force from the apparatus body 2 to be transmitted to the third rotatable members R3.

Referring to FIG. 2, the couplings 23 may be configured to rotate in response to the opening/closing of the front cover 21 or when a driving force is transmitted thereto from a drive source, such as a motor (M), provided in the apparatus body 2. The couplings 23 may be configured to rotate manually, for example by user. Thus, the first and second shutters S1 and S2 can be opened without rotating agitators. The couplings 23 have long grooves, respectively. In a state where the process cartridge 42 is mountable into or demountable from the apparatus body 2 because, for example, the process cartridge 42 has been demounted from the apparatus body 2 or the front cover 21 has been opened, the long grooves 23A extend in the direction in which the process cartridge 42 is mounted into the apparatus body 2. The apparatus body 2 has guiding grooves 2B gradually narrowed toward the couplings 23 so as to guide the third outer engaging portions R31 of the third rotatable members R3.

Referring to FIG. 8B, the third inner engaging portions R32 form guiding grooves. In the state where the first shutters S1 are at the closing positions because, for example, the developer cartridge 7 has been demounted from the developing cartridge DC, the third inner engaging portions R32 extend in the direction in which the developer cartridge 7 is mounted onto the developing cartridge DC (see FIG. 9). That is, when the first shutters S1 are at the closing positions, the first outer engaging portions R11 and the third inner engaging portions R32 extend in the direction in which the developer cartridge 7 is mounted onto the developing cartridge DC. Therefore, when the developer cartridge 7 is mounted onto the developing cartridge DC, the first outer engaging portions R11 and the third inner engaging portions R32 engage with the second rotatable members R2 described separately below.

Referring to FIG. 4, the developer cartridge 7 basically includes the toner case 7A, and a second shutter S2, and a second rotatable member R2.

Figure 7A:
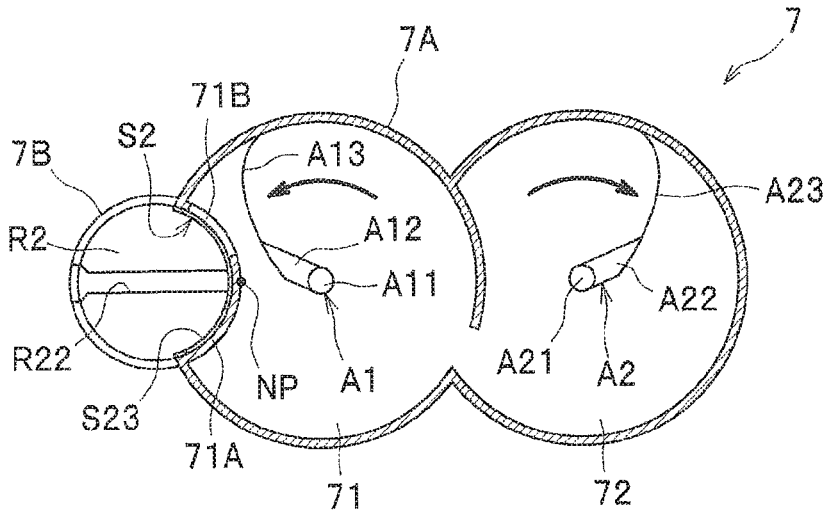
FIGS. 7A and 7B are cross-sectional views of the developer cartridge when the second shutter is at the closing position and at the opening position, respectively.
Figure 7B:
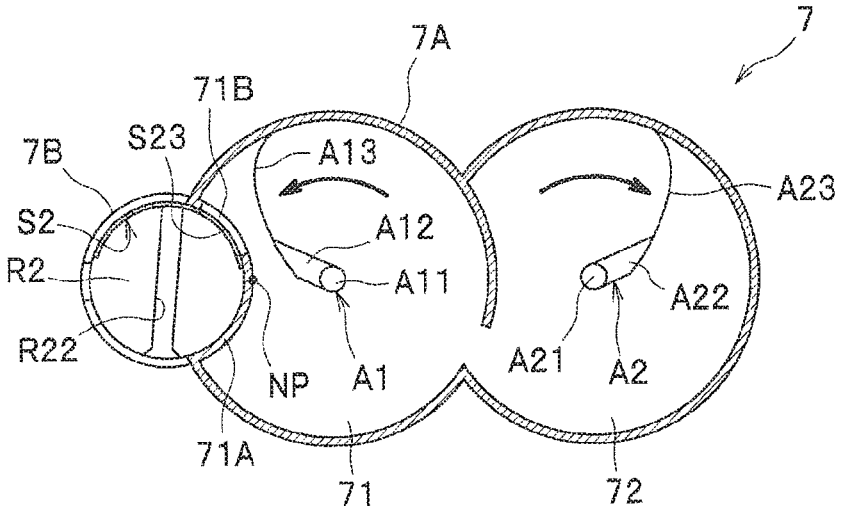

Referring to FIGS. 7A and 7B, the toner case 7A includes two substantially hollow cylindrical chambers, specifically, first and second chambers 71 and 72, in which toner is contained. A first agitator A1 is rotatably provided in the first chamber 71. A second agitator A2 is rotatably provided in the second chamber 72.

The first agitator A1 includes the rotating shaft A11 rotatably supported by the right and left walls of the developer cartridge 7 (the first chamber 71), a support A12 extending outward in the radial direction from the rotating shaft A11, and an agitating blade A13 supported by the support A12. The first agitator A1 rotates (counterclockwise in FIGS. 7A and 7B) in such a manner as to sweep the partition wall 71A from the top to the bottom. Therefore, by the first agitator A1, toner is pushed into the supply port 71B which is formed on an upper half portion of the partition wall 71A having semicylindrical shapes in cross-sectional (on the upstream side in the direction of rotation of the first agitator A1, with respect to a point NP on the partition wall 71A nearest to a rotating shaft A11 of the first agitator A1).

The second agitator A2 includes a rotating shaft A21, a support A22, and an agitating blade A23, as the first agitator A1 does. The second agitator A2 rotates in the opposite direction (clockwise in FIGS. 7A and 7B) to the direction of rotation of the first agitator A1. Therefore, toner accumulated at the bottom of the second chamber 72 is efficiently conveyed to the first chamber 71.

Figure 5A:
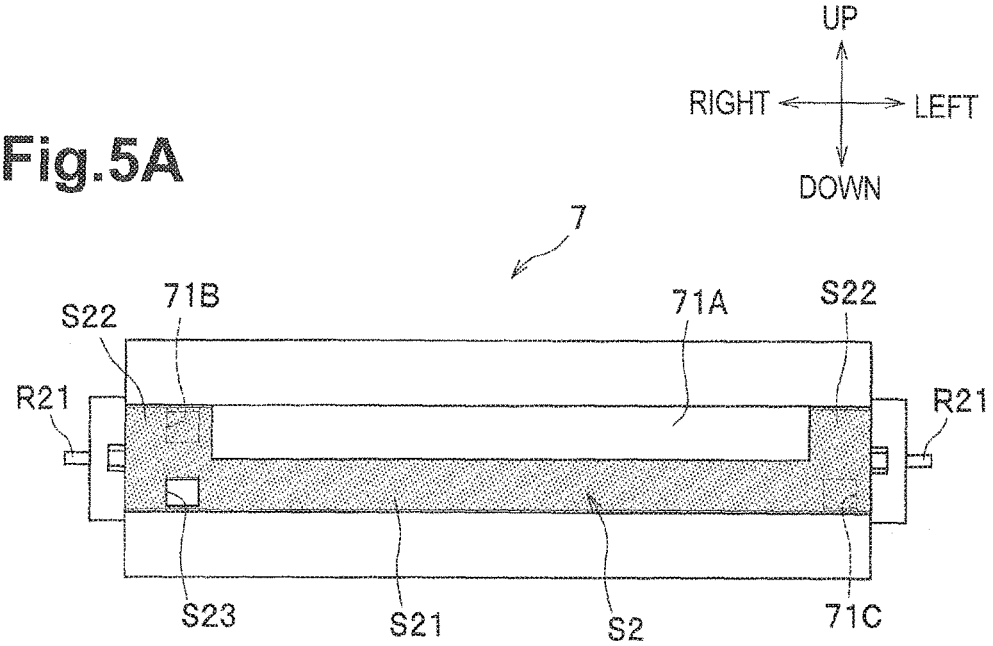
FIGS. 5A and 5B are rear views of the developer cartridge when a second shutter is at a closing position and at an opening position, respectively.
Figure 5B:
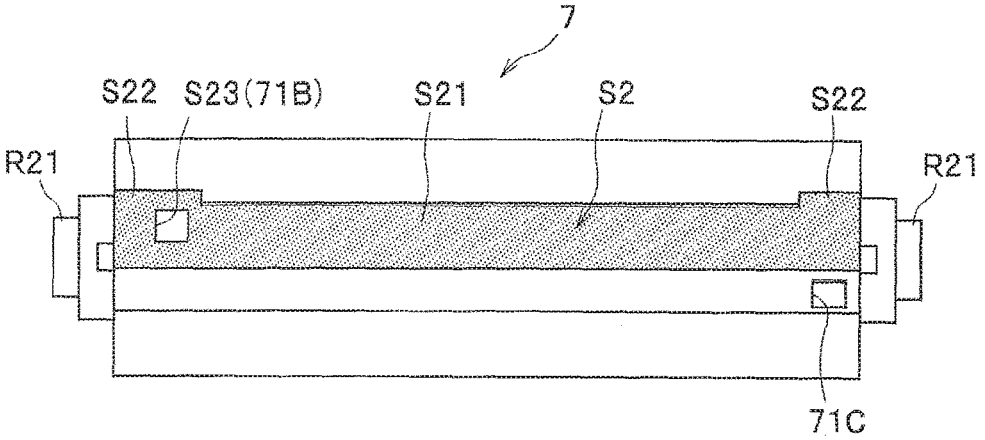

Referring to FIG. 4, the second shutter S2 provided on the developer cartridge 7 has an arc shape in cross-sectional view. Referring to FIG. 5A, the second shutter S2 includes a base portion S21 and extended portions S22. The base portion S21 extends from one of the right and left ends of the partition wall 71A to the other. The extended portions S22 are extended upward from the right and left ends, respectively, of the base portion S21. The base portion S21 has at the right end thereof an opening S23 that is of the same size as the supply port 71B.

When the second shutter S2 is rotated upward from a position at which the right extended portion S22 thereof closes the supply port 71B and the left end of the base portion S21 thereof closes the return port 71C, referring now to FIG. 5B, the supply port 71B is opened through the opening S23 and the return port 71C is opened because the base portion S21 is moved to the upper side with respect to the return port 71C.

Referring to FIG. 4, the second shutter S2 is provided at the axial ends thereof with the second rotatable members R2, respectively, integrally secured thereto in such a manner as to be rotatable together with the second shutter S2. The second rotatable members R2 are exemplary second operating portions and are disc-like members whose centers coincide with the center of curvature of the second shutter S2 having an arc shape in cross-sectional view. The second rotatable members R2 are rotatably held at the entire peripheries thereof by ring-shaped holding members 7B, respectively, provided on the toner case 7A.

Referring to FIG. 9, when the developer cartridge 7 is mounted onto the developing cartridge DC, each of the second rotatable members R2 advances into a space between a corresponding one of the first rotatable members R1 and a corresponding one of the third rotatable members R3 and engages with the first rotatable member R1 and the third rotatable member R3 such that the directions of rotation of the rotatable members R1, R2, and R3 match. Thus, the second rotatable members R2 rotate (operate) together with the first and third rotatable members R1 and R3.

Specifically, the second rotatable members R2 are configured such that, when the developer cartridge 7 is mounted onto the developing cartridge DC, the axes of rotation of the second rotatable members R2 coincide with the axes of rotation of the first and third rotatable members R1 and R3. Furthermore, referring to FIG. 4, the second rotatable members R2 have second outer engaging portions R21, respectively, on the outer faces thereof (on the faces thereof near the third operating portions) and second inner engaging portions R22, respectively, on the inner faces thereof (on the faces thereof near the first operating portions).

The second outer engaging portions R21 are projections projecting laterally outward and forming long ribs. In a state where the second shutter S2 is at a closing position, the second outer engaging portions R21 extend in the direction in which the developer cartridge 7 is mounted onto the developing cartridge DC (see FIG. 9). The second inner engaging portions R22 form guiding grooves. In the state where the second shutter S2 is at the closing position, the second inner engaging portions R22 extend in the direction in which the developer cartridge 7 is mounted onto the developing cartridge DC (see FIG. 9).

Therefore, as shown in FIG. 9, when the developer cartridge 7 is mounted onto the developing cartridge DC, the second outer engaging portions R21 and the second inner engaging portions R22 engage with the first outer engaging portions R11 and the third inner engaging portions R32, respectively.

Figure 10A:
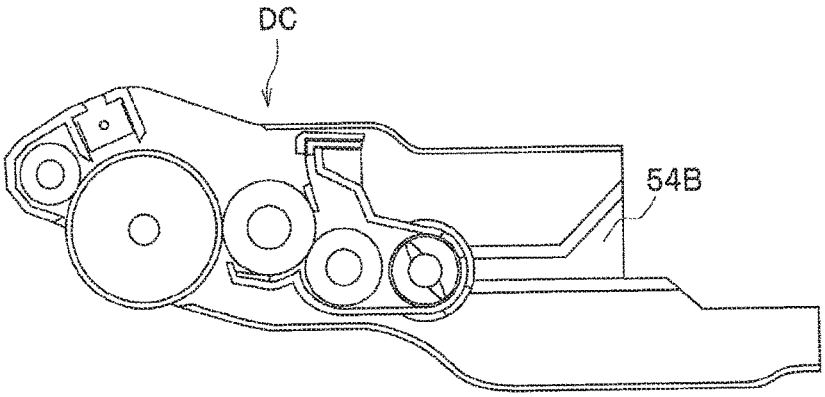
FIGS. 10A and 10B are a cross-sectional view of the developing cartridge without the developer cartridge and another cross-sectional view showing a state where the developer cartridge is being mounted onto the developing cartridge, respectively.
Figure 10B:
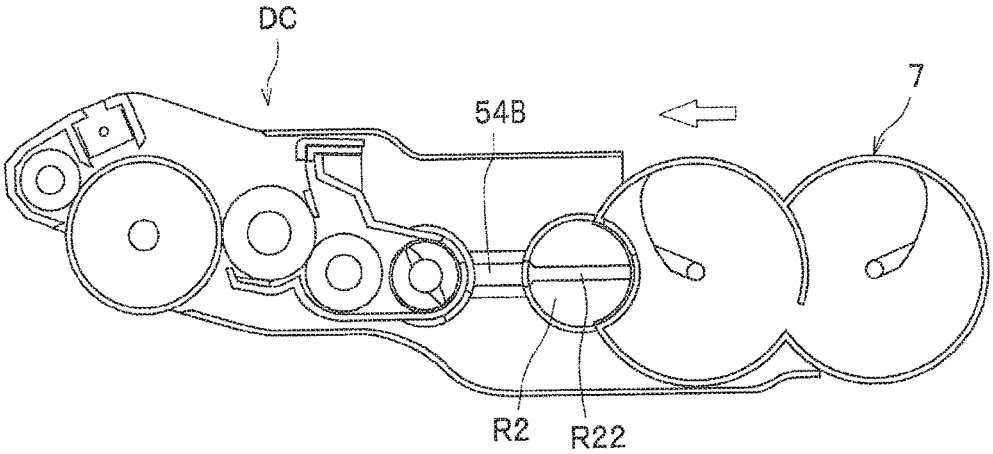

Referring to FIG. 4, the holding members 7B provided on the toner case 7A have in rear portions thereof notches 7C, respectively, corresponding to the second inner engaging portions R22 forming guiding grooves. Referring to FIG. 8B, the frames 54 of the drum unit 5 have on the inner faces thereof guiding grooves 54B, respectively, each defined by two ribs. The guiding grooves 54B are gradually narrowed toward the third rotatable members R3 so as to guide the second outer engaging portions R21 of the second rotatable members R2 to the third inner engaging portions R32 of the third rotatable members R3. The second outer engaging portions R21 are guided along the guiding grooves 54B, and the second rotatable members R2 each advance into a space between a corresponding one of the first rotatable members R1 and a corresponding one of the third rotatable members R3, whereby the relevant engaging portions assuredly engage with one another (see FIGS. 10A and 10B).

Referring to FIG. 3, gaps G are provided between the second rotatable members R2 and the corresponding third rotatable members R3 in such a manner as to allow the second rotatable members R2 to be movable relative to the third rotatable members R3 in a direction in which the developing roller 61 faces the photosensitive drum 51 (the direction is hereinafter referred to as the facing direction). Specifically, in the state where the developer cartridge 7 is on the developing cartridge DC and the first and second shutters S1 and S2 are at opening positions, the short-side direction of the second outer engaging portions R21 of the second rotatable members R2 and the third inner engaging portions R32 of the third rotatable members R3 substantially correspond to the facing direction. The gaps G are provided in the short-side direction.

A rotating shaft 61A of the developing roller 61 and a rotating shaft 63A of the supplying roller 63 are held by the right and left frames 54 of the drum unit 5 in such a manner as to be movable in the facing direction. Specifically, referring to FIGS. 8A and 8B, the right and left frames 54 of the drum unit 5 have oval holes 54C and 54D extending in the facing direction. The rotating shaft 61A of the developing roller 61 and the rotating shaft 63A of the supplying roller 63 are held in the oval holes 54C and 54D in such a manner as to be rotatable and to be movable in the facing direction.

Thus, the developing device 6 is supported in such a manner as to be movable in the facing direction relative to the drum unit 5, and the developing roller 61 is movable in the facing direction relative to the photosensitive drum 51. This allows the developing roller 61 to follow the deflection of the photosensitive drum 51 occurring during rotation (the deflection due to surface irregularities of the photosensitive drum 51) in a case where, for example, the developing roller 61 is urged against the photosensitive drum 51 with a spring. Furthermore, the developing roller 61 can be moved away from the photosensitive drum 51 according to need.

The embodiment described above provides the following benefits. In a state where only the developing cartridge DC is in the apparatus body 2, the second rotatable members R2 are not present in the spaces between the third rotatable members R3 and the first rotatable members R1. Therefore, even if a driving force is transmitted from the apparatus body 2 to the third rotatable members R3, the driving force is not transmitted to the first rotatable members R1, and the first shutters S1 are not moved to the opening position. In a state where only the developer cartridge 7 is in the apparatus body 2, the third rotatable members R3 are not present in the spaces between the second rotatable members R2 and the couplings 23 of the apparatus body 2. Therefore, the driving force from the apparatus body 2 is not transmitted to the second rotatable members R2, and the second shutter S2 is not moved to the opening position. That is, in the state where only one of the two cartridges DC and 7 is in the apparatus body 2, toner leakage due to unintended movements of the shutters S1 and/or S2 to the opening positions is reduced.

The first outer engaging portion R11 and the second inner engaging portion R22 extend in the direction in which the developer cartridge 7 is mounted onto the developing cartridge DC when the shutters S1 and S2 are closed. Therefore, the first outer engaging portion R11 and the second inner engaging portion R22 are made to engage by mounting the developer cartridge 7 onto the developing cartridge DC. Thus, the efficiency of work is increased.

The second outer engaging portion R21 and the third inner engaging portion R32 extend in the direction in which the developer cartridge 7 is mounted onto the developing cartridge DC when the shutters S1 and S2 are closed. Therefore, the second outer engaging portion R21 and the third inner engaging portion R32 are made to engage by mounting the developer cartridge 7 onto the developing cartridge DC. Thus, the efficiency of work is increased.

The third outer engaging portion R31 extends in the direction in which the developing cartridge DC is mounted onto the apparatus body 2 when the shutter S1 is closed. Therefore, the third outer engaging portion R31 is made to engage with the coupling 23 of the apparatus body 2 by mounting the developing cartridge DC onto the apparatus body 2. Thus, the efficiency of work is increased.

The shutters S1 and S2 are configured to move along the peripheries of the partition walls 65A and 71A having arc shapes. Therefore, the shutters S1 and S2 are movable more smoothly than in a case where the shutters S1 and S2 are configured to move axially.

The rotatable members R1, R2, and R3 are positioned such that the axes of rotation thereof coincide. Such a configuration is simpler than a configuration in which the axes of rotation of the rotatable members R1, R2, and R3 do not coincide. Moreover, a driving force is transmitted more efficiently than in the configuration in which the axes of rotation of the rotatable members R1, R2, and R3 do not coincide.

The gaps G provided between the second rotatable members R2 and the third rotatable members R3 allow the second rotatable members R2 to be movable relative to the third rotatable members R3. This further allows the developing roller 61 to follow the deflection of the photosensitive drum 51 occurring during rotation in a case where, for example, the developing roller 61 (the developing device 6) is urged against the photosensitive drum 51 with a spring. Moreover, in the event that paper P is jammed between the developing roller 61 and the photosensitive drum 51, the developing roller 61 can be moved away from the photosensitive drum 51, whereby the jam is cleared in a good manner.

The rotatable members R1, R2, and R3 are provided at both sides of the second shutter S2. Therefore, the second shutter S2 is smoothly opened/closed without being twisted, by the rotatable members R1, R2, and R3 of the both sides.

The present invention is not limited to the above embodiment and may be embodied in various ways as exemplified below.

In the embodiment, the gaps G provided between the second rotatable members R2 and the third rotatable members R3 allow the developing cartridge DC (the developer cartridge 7) to be movable relative to the drum unit 5. The present invention is not limited to such a configuration. For example, referring to FIG. 3, gaps between the frames 54 of the drum unit 5 and the third rotatable members R3 may alternatively be increased such that the developing cartridge DC (the developer cartridge 7) is movable relative to the drum unit 5. Such a configuration produces the same effect as in the embodiment.

In the embodiment, the shutters and the operating portions (the first rotatable members R1 and so forth) are rotatable. The present invention is not limited to such a configuration. It is only necessary that the shutters and the operating portions operate simultaneously. For example, the shutters and the operating portions may alternatively be movable translationally in the vertical direction (in the short-side direction of the engaging portions, or in a direction orthogonal to the direction in which the cartridges are mounted). Moreover, the operating portions may be provided only at one of the axial ends of the developing roller 61.

In the embodiment, two first shutters S1 are provided on the developing device 6. The present invention is not limited to such an embodiment. For example, a single shutter may alternatively be provided on the developing device 6. The positions and numbers of supply ports and return ports are not limited to those specified in the embodiment, and may be specified according to need.

The concave and convex shapes of the engaging portions R11, R21 and so on, and the couplings 23 and so forth according to the embodiment may be reversed according to need.

The embodiment of the present invention concerns the laser printer 1. The present invention is not limited to be applied to the laser printer 1, and may be applied to any other image-forming apparatuses such as a copier, a multifunctional machine, and the like.

In the embodiment, the photosensitive drum 51 is employed as a photosensitive member. The present invention is not limited to such an embodiment. For example, a belt-like photosensitive member may alternatively be employed.

What is claimed is:

1. An image forming apparatus comprising:

a photosensitive drum;

a developing roller configured to develop a developer image on the photosensitive drum and including a first shaft, the developing roller extending in a first direction in which the first shaft extends;

a supply roller configured to contact the developer roller to supply developer to the developer roller and extending in the first direction;

a case in which the supply roller is located and having an input port; and a developer container configured to contain developer and extending in the first direction, a distance between one end of the developer container and the other end of the developer container being larger than a distance between one end of the supply roller and the other end of the supply roller, the developer being conveyed between the one end of the developer container and the other end of the developer container in the first direction, the developer container having an output port positioned between the other end of the developer container and the other end of the supply roller in the first direction, the output port communicating with the input port of the case such that the developer is supplied from the output port of the developer container via the input port of the case to the supply roller.

2. The image forming apparatus according to claim 1, wherein the case further has an output port, and the developer container further has an input port, and wherein the output port of the case communicates with the input port of the developer container such that the developer is returned from the output port of the case via the input port of the developer container to the developer container.

3. The image forming apparatus according to claim 2, wherein the input port of the developer container is positioned between the one end of the developer container and the one end of the supply roller in the first direction.

4. The image forming apparatus according to claim 2, wherein each of the output port of the developer container and the input port of the developer container opens downward.

5. The image forming apparatus according to claim 2, wherein each of the output port of the developer container and the input port of the developer container is configured to be opened and closed by a shutter.

6. The image forming apparatus according to claim 2, wherein the developer is conveyed from the one end of the developer container to the other end of the developer container in one direction of the first direction, and conveyed through the output port of the developer container and the input port of the case to the supply roller, and then conveyed from the other end of the supply roller to the one end of the supply roller in an opposite direction of the one direction, of the first direction.

7. The image forming apparatus according to claim 1, wherein the photosensitive drum, the case and the developer container are arranged in this order in a horizontal direction perpendicular to the first direction.

8. The image forming apparatus according to claim 1, wherein the case further comprises an agitator configured to convey the developer along a shaft of the supply roller.

9. The image forming apparatus according to claim 8, wherein the agitator is an auger.

10. The image forming apparatus according to claim 1, further comprising:

a developer cartridge and a developing cartridge, the developer cartridge being attachable to and detachable from the developing cartridge in a second direction perpendicular to the first direction, the developer cartridge comprising the developer container, the developing cartridge comprising the photosensitive drum, the developing roller, the supply roller, and the case.

* * * * *